US005337663A

United States Patent [19]

McKillip

[11] Patent Number: 5,337,663

[45] Date of Patent: Aug. 16, 1994

[54] COMBINATION STENCIL AND LABEL APPARATUS AND METHOD FOR FORMING AND ATTACHING SAME

[76] Inventor: John J. McKillip, 25 W. 153 Ridgeland, Naperville, Ill. 60350

[21] Appl. No.: 902,870

[22] Filed: Jun. 23, 1992

[51] Int. Cl.[5] ..... B41L 13/02; B41N 1/24

[52] U.S. Cl. ..... 101/127.1; 101/128.1; 101/128.21; 156/277

[58] Field of Search ..... 101/125, 127.1, 128.1, 101/128.21, 128.4, 129; 156/62, 277

[56] References Cited

U.S. PATENT DOCUMENTS

| | | | |
|---|---|---|---|
| 1,084,314 | 1/1914 | Choate | 101/128.4 |
| 1,937,751 | 12/1933 | Elliott | 101/128.21 |
| 2,070,181 | 2/1937 | Ryan | 101/128.1 |
| 2,674,940 | 4/1954 | Carney | 101/128.21 |
| 2,976,802 | 3/1961 | Mason | 101/128.1 |
| 3,094,342 | 6/1963 | Weber | 101/128.1 |
| 4,348,953 | 9/1982 | Cole et al. | 101/128.4 |
| 4,664,031 | 5/1987 | McKillip | 101/127.1 |

OTHER PUBLICATIONS

Specimen of stencil product, circa at least as early as 1956 and currently manufactured by US Stencil Co.

*Primary Examiner*—Edgar S. Burr
*Assistant Examiner*—Stephen R. Funk
*Attorney, Agent, or Firm*—Dick and Harris

[57] ABSTRACT

A combination stencil and label apparatus and method for forming and attaching same wherein the apparatus can be applied directly or indirectly to business forms, packaging and other surfaces. A web of stencil material is removably attached to a juxtaposed web of label material which is then cut to form a plurality of stencil assemblies. The stencil assemblies, which may include preliminarily impressed indicia, are then manually, or automatically applied to, for example, a business form. The label material may also include an image producing liner which simultaneously accepts and displays the indicia impressed on the stencil material and, in turn, the label. Furthermore, the stencil material, label material and liner material are each releasably attached to one another so as to facilitate independent use after initial affixation to the business form.

9 Claims, 2 Drawing Sheets 30
20
36
25
38
3
3
FROM
40
SHIP TO
INV.NO.
ATTN:
49
27
28

20
30
62
63
65
64
36
47
25
38
27
28
67
57
35
50
37
49
59

20
30
62
25
36
FROM
40
SHIP TO
INV.NO.
38
ATTN:
45
27
109
FROM
40a
SHIP TO
INV.NO.
28
49
108
ATTN:
FROM
40b
SHIP TO
INV.NO.
ATTN:
60
59
55

170
179
171
181
180

175
170
171
176

100
107
101
105
115
110

COMBINATION STENCIL AND LABEL APPARATUS AND METHOD FOR FORMING AND ATTACHING SAME

BACKGROUND OF THE INVENTION

The present invention relates in general to indicia transfer devices, and in particular, to a combination stencil and label apparatus and a method for forming and attaching same, for use in association with business forms, packaging and other surfaces.

Traditionally, stencil devices have been used in association with business forms, as well as in association with stencil applicators, for applying indicia imprinted on the top surface of the stencil onto other surfaces, such as shipping containers, so as to "link" such other surfaces with information initially impressed on the business form which the stencil originated. Typically, the stencil is removably attached to a business form, such as a purchase order or invoice, after the stencil has been impressed with indicia, such as recipient, address, shipping instructions and/or invoice numbers. The stencil itself includes a carbon layer on its second side which facilitates simultaneous transfer of the indicia impressed on the stencil, to the business form. Accordingly, if the invoice, for example, references that twenty shipping containers are to be shipped to a single customer, then the stencil is removed from the invoice and attached to a stencil applicator. The stencil applicator is then used to impress the information previously impressed on the stencil and business form, directly onto the surface of each of the shipping containers. After all shipping containers have been identified, the stencil may be thrown away.

Although such prior art stencils have been acceptable, they are quite inefficient when only one or two shipping containers, or other surfaces, need to be marked with the information impressed on the stencil. Additionally, although such stencils have been applied to business forms, and the like, through the use of automated equipment, such automated applications have been relatively slow due to the relatively "flimsy nature" of the stencil material. On the other hand, labels (some of which have image-producing liners), which can also be applied to business forms on automated equipment, can be applied to business forms at relatively high speeds—due to their substantially "less flimsy" nature.

Furthermore, while stencils, as well as labels, are both known in the art, few, if any of such prior art devices teach, much less disclose, a combination stencil and label apparatus—let alone a stencil and label apparatus which facilitates independent use of both portions, if needed, for purposes of applying the indicia referenced on the business form with one or more various surfaces, such as the surface of a shipping container and/or package. In addition, while prior art labels have been used with image-producing liners, none of such prior art discloses such an image-producing liner for use in association with a stencil, nor, for use in association with a business form, and other surfaces, where the label, and/or the liner, and the stencil, also facilitate independent use of each other after initial attachment to the business form.

It is thus an object of the present invention to provide a combination stencil and label apparatus which can be applied to a business form manually, or via automation, wherein such automation may be through the use of, among other machinery, a tipping machine or a label applicator, such as a "Label-Aire" machine.

It is another object of the present invention to provide a combination stencil and label apparatus wherein the apparatus includes a label having an image-producing liner which visually displays the indicia impressed on the stencil and, in turn, the label itself, so as to enable independent removal and use of the label and stencil from the liner, while the liner (having identical indicia as that shown on the label and stencil) remains attached to the business form.

It is still further an object of the present invention to provide a method of forming the combination stencil and label apparatus wherein the stencil portion is removably attached to the label portion by an attachment strip.

And, it is further an object of the present invention to provide a method of producing a combination stencil and label apparatus at relatively high speeds.

These and other objects of the present invention will become apparent in light of the present specification, claims and drawings.

SUMMARY OF THE INVENTION

The present invention comprises a combination stencil and label apparatus for use in association with business forms, packaging and other surfaces, such as shipping containers, wherein the stencil portion of the apparatus is of the type possessing means to accept the impression of indicia which is simultaneously transferred to an underlying surface, and, wherein the stencil portion of the apparatus can be removed, in a facilitated manner, from the underlying surface, so as to enable reproduction of the impressed indicia on the other surfaces, such as shipping containers, in cooperation with a stencil applicator.

The combination stencil and label apparatus comprises label means for operable attachment to the business forms, and other surfaces, as desired. The label means have a top surface, a bottom surface, and an outer periphery. Adhesive means are operably applied to at least a portion of the bottom surface of the label means for facilitating securement of the label means to one or more of the business forms and/or other surfaces.

A planar ply of stencil material has a first side, a second side, and an outer periphery. The second side is positioned in juxtaposed alignment with the top surface of the label means. The stencil material has a substantially planar layer of carbon integrated into the second surface to enable the simultaneous imprinting of the indicia to the top surface of the label means. In addition, the stencil material and the label means are releasably attached to each other by attachment means. Accordingly, the stencil material is detachable from the label means so as to enable independent use of the stencil material and/or label means in cooperation with other surfaces, such as shipping containers and packaging.

The combination stencil and label apparatus may also include preliminarily imprinted indicia prior to the use in association with the business forms, packaging and other surfaces—although imprinting the indicia after attachment and/or use is also contemplated.

In the preferred embodiment of the invention, the combination stencil and label apparatus further includes liner means which are operably attached to the bottom surface of the label means. The liner means have an upper surface, a lower surface and a peripheral edge.

The upper surface is operably attached to the bottom surface of the label means and the lower surface is attachable to business forms, packaging or other various surfaces.

In another preferred embodiment of the invention, the liner means further includes image-producing means which are integrated into the upper surface of the liner means for accepting and visually displaying the indicia impressed upon the stencil material and, in turn, the label means, upon simultaneous imprinting of the stencil material and the label means, to impart to the liner means indicia identical to the indicia impressed on the stencil material and, accordingly, the label means. Furthermore, the liner means is capable of remaining restrainably attached to the business forms, packaging and other various surfaces, while the label means and the stencil material are removable from the liner means, as well as each other, for application to another one of the other various surfaces.

In one embodiment of the invention, the liner means comprises a "single-ply" image-producing liner. In another embodiment, the liner means comprises a "piggy-back" liner material having a carrier medium attached thereto—although it is also contemplated that the liner means comprise a non-piggy-back material having a carrier medium for temporarily supporting one or more of the combination stencil and label apparatuses.

In the preferred embodiment of the invention, the liner means has substantially the same configuration as the label means and the stencil material. For example, the apparatus may be constructed to have a substantially rectangular configuration. Preferably, such a configuration is cut with each of the corners having a radius of curvature of approximately one-fourth of an inch—although other dimensions are also contemplated.

The present invention further comprises a method for forming and attaching a combination stencil and label apparatus to various surfaces, such as business forms and shipping containers, wherein the stencil portion of the apparatus is of the type possessing means to accept the impression of indicia which is simultaneously transferred to an underlying surface.

The method for forming and attaching the stencil and label apparatus comprises the steps of (a) continuously feeding a web of label material into juxtaposition with a continuously fed web of stencil material, wherein the web of label material is operably attached to a label carrier medium; (b) releasably attaching the stencil material to the juxtapositioned label material by a continuously fed web of attachment material; (c) die-cutting the releasably attached stencil material, label material and attachment material so as to form a plurality of stencil assemblies, wherein the die-cut stencil assemblies are removably maintained on the carrier medium; and (d) transferring the stencil assemblies onto one of the various surfaces.

In the preferred embodiment of the invention, the method further comprises the step of applying adhesive to a portion of the label material so as to enable releasable affixation between the stencil material and the juxtaposed label material.

In another preferred embodiment of the invention, the method further includes the step of severing the carrier medium, after the step of die-cutting the stencil material, label material and attachment material, so as to form a plurality of individual stencil assemblies comprised of the stencil material, label material, attachment material and carrier medium.

Additionally, it is also contemplated that after the severing step, that the method further include the steps of: (a) transferring the individual stencil assemblies on a continuous basis to a continuous applicator positioned in operable alignment with a substantially continuous web of joined business forms; (b) preliminarily depositing an adhesive compound on a predetermined location of each of the business forms at a stencil attachment region, for the aligned acceptance of one of the individual stencil assemblies thereupon; (c) continuously aligning and applying the lower surface of the respective carrier material of one of the individual stencil assemblies at a position atop the deposited adhesive compound for aligned contact therebetween; and (d) bonding the lower surface of the carrier material of the respective individual stencil assemblies to each of the respective business forms by compressing together, the individual stencil assemblies along with the adhesive compound at the predetermined locations of the business forms.

In another preferred embodiment of the invention, the method of forming and attaching the combination stencil and label apparatus further includes the steps of: (a) continuously feeding the plurality of stencil assemblies as well as the label carrier medium into a single roll of stencil-label carrier medium material; (b) transferring the plurality of stencil assemblies, from the roll of stencil-label carrier medium material, one at a time, to a continuous web of the various surfaces, such as business forms; and (c) discarding any unused portion of label carrier medium upon removing and transferring the stencil assemblies onto such various surfaces.

DETAILED DESCRIPTION OF THE DRAWINGS

Figure 1:
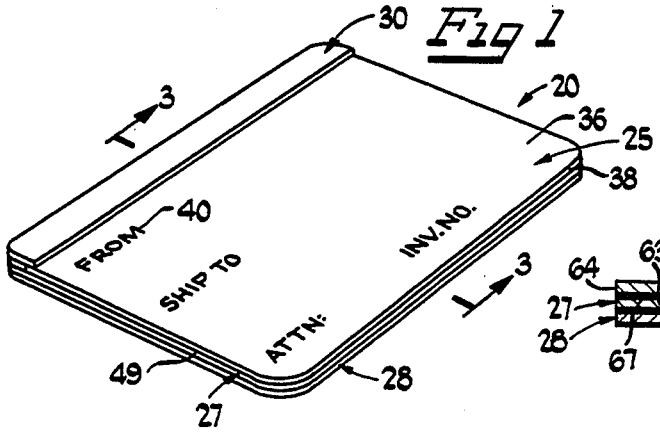
FIG. 1 of the drawings is a perspective view of one embodiment of combination stencil and label apparatus showing, in particular, the planar ply of stencil material, the label means, the liner means and the attachment means.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 3:
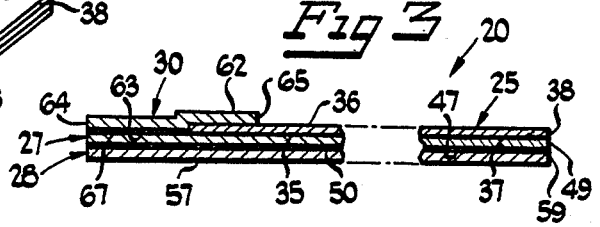
FIG. 3 of the drawings is a cross-sectional view of the combination stencil and label apparatus, taken generally along lines 3—3 of FIG. 1, and looking in the direction of the arrows, showing in particular, the positioning of the attachment means to the first side of the stencil material and the top surface of the label means, as well as the carbon layer integrated into the second side of the stencil material.
Figure 2:
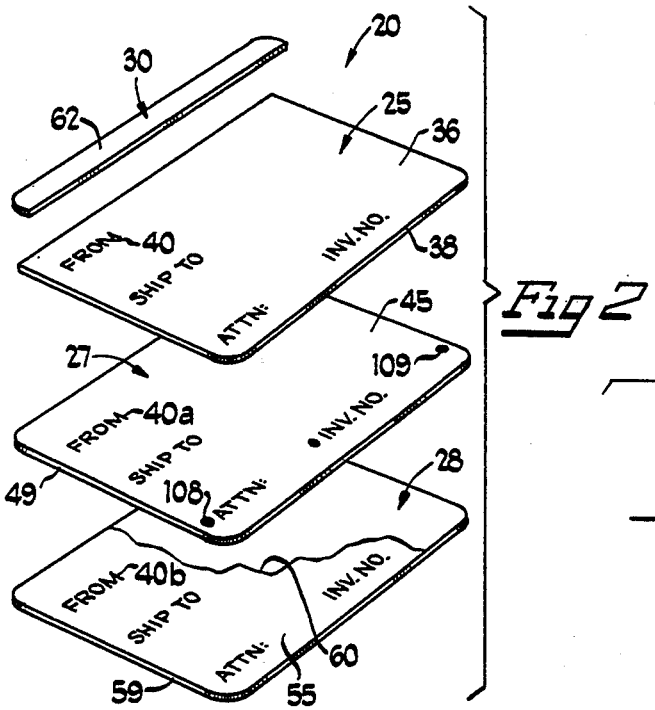
FIG. 2 of the drawings is an exploded perspective view of the combination stencil and label apparatus of FIG. 1, showing, in particular, the indicia which has been simultaneously transferred and visually displayed from the stencil apparatus to the label means and the liner means.

Combination stencil and label apparatus 20 is shown in FIG. 1, FIG. 2 and FIG. 3 as comprising planar ply of stencil material 25, label means 27, liner means 28 and attachment means 30. Stencil material 25 includes first side 36, second side 37 (FIG. 3), and outer periphery 38. First side 36 includes indicia, such as indicia 40, which has been impressed onto the first side of the stencil material and then simultaneously transferred to top surface 45 (FIG. 2) of label means 27 as a result of a planar layer of carbon 35 (FIG. 3) integrated into second side 37 of the stencil material.

Label means 27, includes top surface 45 (FIG. 2), bottom surface 47 (FIG. 3) and outer periphery 49. Top surface 45 includes indicia, such as indicia **40*a* (FIG. 2), which, as previously explained, originated upon the simultaneous impressing of indicia 40 on stencil material 25. Additionally, bottom surface 47 of label means 27 includes adhesive 50 (FIG. 3) which is used to releasably attach label means 27 to liner means 28**.

Liner means 28 includes upper surface 55 (FIG. 2), lower surface 57 (FIG. 3) and peripheral edge 59. Upper surface 55 includes image-producing means 60 (FIG. 2), which simultaneously accepts and visually displays indicia, such as indicia **40*b*, upon the simultaneous impressing of indicia 40 and 40*a* on stencil material 25 and label means 27**, respectively. Such image-producing liner means, as well as labels which are attached to liners, are known to those skilled in the art. Indeed, two examples of such liners and/or label/liner assemblies are commonly referred to as "piggy-back" labels with image-producing liners, and, "single-ply" image-producing liners. Although the combination stencil and label apparatus is shown as having preformed indicia, the use of such an apparatus without such preformed indicia is also contemplated. Furthermore, although the use of an image-producing liner is preferred, non-image-producing liners and/or liners which merely function as carrier mediums, are likewise contemplated.

Attachment means 30 (as shown in detail in FIG. 3), includes top side 62, bottom side 63, back edge 64 and front edge 65. Bottom side 63 of attachment means 30 includes adhesive 67 which facilitates releasable attachment of stencil material 25 to a portion of top surface 45 of label means 27. Inasmuch as attachment means 30 utilizes releasable adhesive characteristics, any commercially available adhesive possessing such characteristics, such as latex rubber cement, can be used. Indeed, a suitable product for use as the attachment means itself is the commercially available adhesive system embodied in the product marketed as "Post-It" Brand Notes—a product which is manufactured by the 3M Corporation.

Inasmuch as stencil material 25, label material 27, and liner means 28 each simultaneously accept and visually display the indicia impressed upon first side 36 of stencil material 25, each of these three layers can be used independently of each other for providing corresponding data, which, for example, links other surfaces, such as shipping containers, to which the label material, or, the indicia impressed on the stencil, may be applied, to the business form from which they originated. In addition, the liner means, which may remain on the business form, will serve to reveal the corresponding indicia applied to those other surfaces.

Figure 4:
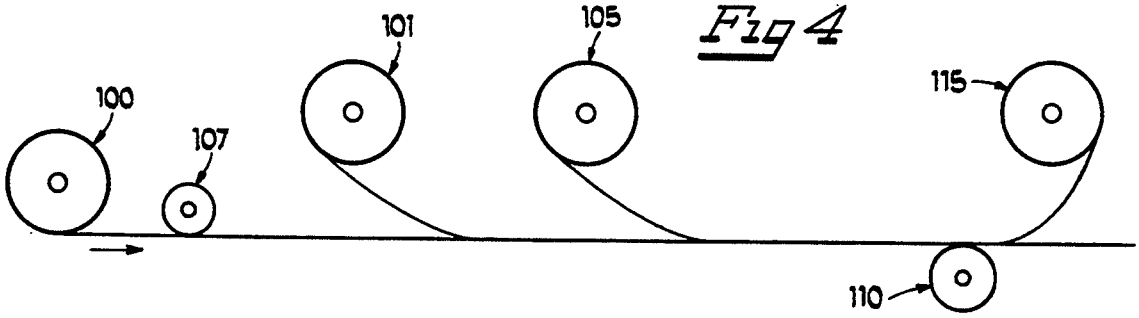
FIG. 4 of the drawings is a schematic view of the method for forming a combination stencil and label apparatus, showing in particular, the web of label material, the adhesive applicator, the web of stencil material, the web of attachment material, the die cutter and the web of matrix which results from the die cut waste.
Figure 5:
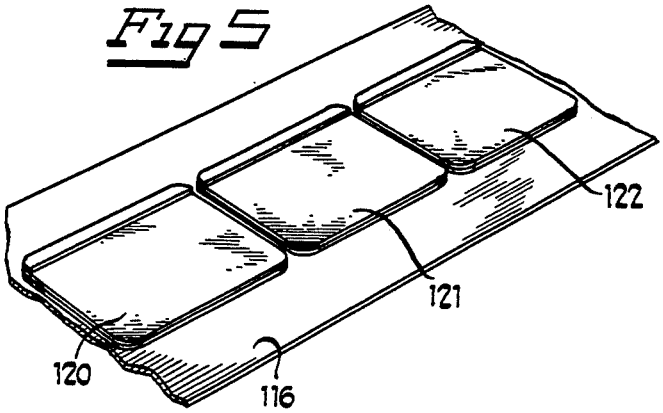
FIG. 5 of the drawings is a perspective view of the individual stencil assemblies after being die cut, and, showing the releasable attachment of the stencil assemblies to the carrier medium.

A schematic view of the method through which a sheet of individual stencil assemblies are formed is shown in FIG. 4 in which a substantially continuous web of label material 100, is fed into juxtaposition with a continuously fed web of stencil material 101, and then both of those webs are continuously fed into operable alignment with a continuously fed web of attachment material 105—which releasably attaches the stencil material to the label material. After such releasable attachment has occurred, the attached material is fed past die-cutter 110 which die-cuts the attached material into individual stencil assemblies, such as individual stencil assemblies 120 through 122, as shown in FIG. 5. Also shown in FIG. 4 is adhesive applicator 107 and take up reel 115. Adhesive applicator 107 applies releasable spots of an adhesive compound (such as adhesive compound 108 and 109, as shown in FIG. 2) which is used to reduce the likelihood of potential "jamming" during the manufacturing operation, which could result from the stencil material freely flapping around during such manufacturing. Furthermore, take up reel 115 collects the matrix, or scrap material, removed from the web of material after the die-cutting of same.

As previously explained, both "piggy-back" liners/-labels with image-producing liners, and "single-ply" image-producing liners, (among others), are contemplated for use. If a "piggy-back" label is used, the "mid" liner, which possesses image-producing means, will be adhesively attached to a commercially available silicon treated carrier medium 116 (FIG. 5). If, on the other hand, a "single-ply" image-producing liner is used, then the carrier medium will actually be treated with image-producing means—a material which is also commercially available.

Figure 6:
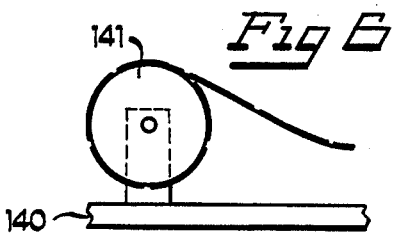
FIG. 6 of the drawings is an elevated front view of a continuous web of the individual stencil assemblies and carrier medium, after the web has been supplied to a Label-Aire machine.

Individual stencil assemblies (such as assemblies 120 through 122), which incorporate a "piggy-back" label, are shown in FIG. 5. As can be seen, the die-cutter had cut such assemblies with rounded corners as well as spaces between each respective individual stencil assembly. The radius of curvature of the corners of each stencil assembly, as well as the spacing cut between each assembly, by the die-cutter, is required when application of the individual stencil assemblies to business forms, and the like, is contemplated through use of a commercially available "Label-Aire" machine 140, as shown in FIG. 6. For example, the Label-Aire machine may require that the individual stencil assemblies be spaced approximately one eighth of an inch apart, and that each of the corners of each stencil assembly have approximately one fourth of an inch radius of curvature for effective operation. In addition, if a Label-Aire machine is to be used, the sheet of individual stencil assemblies must be rolled into web form 141, as shown in FIG. 6.

Figure 8:
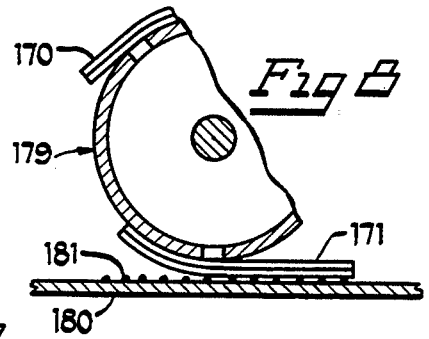
FIG. 8 of the drawings is a cut-away sectional view of the severed individual stencil assemblies being attached to continuously fed business forms by a tipping machine.
Figure 7:
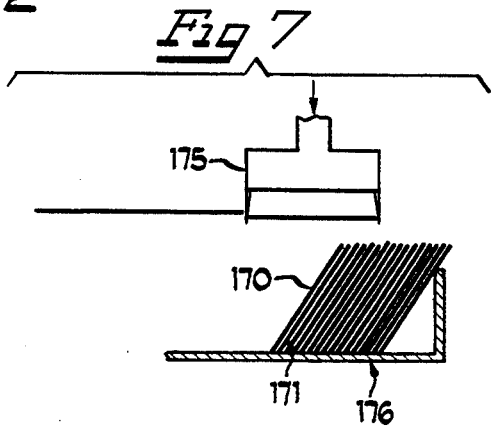
FIG. 7 of the drawings is a partially schematic, elevated view of the severing and stacking arrangement of the individual stencil assemblies, prior to attaching same to business forms in association with a tipping machine.
Figure 9:
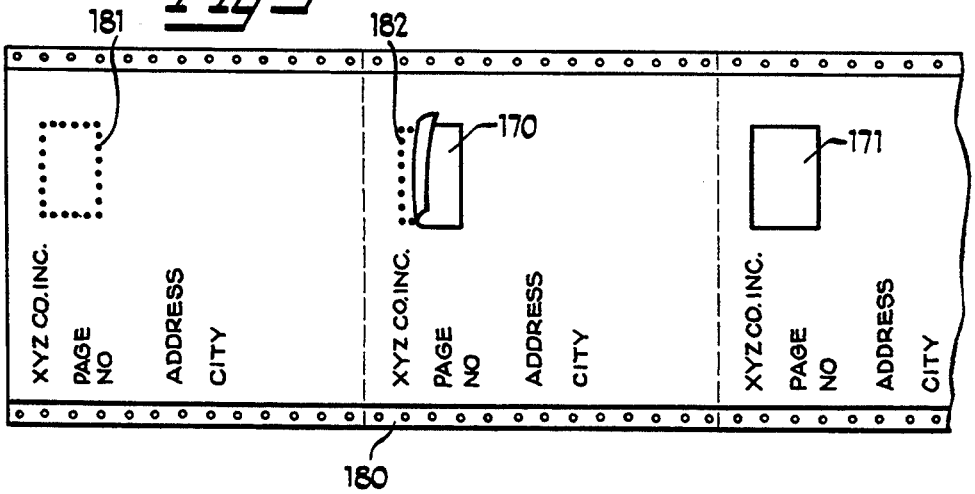
FIG. 9 of the drawings is a top plan view of the individual stencil assemblies as they are being applied to business forms by a tipping machine, and, showing in particular, the globules of glue applied by the tipping machine, to the business forms, which will secure the stencil assemblies thereto.

An alternative method of forming and attaching individual stencil assemblies, such as stencil assemblies 170 and 171, is shown in FIGS. 7 through 9, wherein such individual assemblies are formed in accordance with the method previously explained in reference to FIG. 4 of the drawings, with the exception of the use of a "single-ply" image-producing liner (as opposed to "piggy-back"), and, accordingly, without the need for a die-cut operation. Furthermore, instead of rolling the individual stencil assemblies into web form, they will remain in sheet form for continuous feeding toward a severing device 175 (FIG. 7), which severs the stencil, label, and attachment material, into independent, individual stencil assemblies, such as individual stencil assemblies 170 and 171. After such severing has occurred, the independent individual stencil assemblies are automatically stacked at a stacking station 176 (FIG. 7). These stacked individual stencil assemblies are then transferred and individually fed toward and into cooperation with a tipping machine 179 (known in the art), as shown in FIG. 8, where they are applied to predetermined locations on continuously fed business forms, such as business form 180 (FIGS. 8 and 9). Also shown in FIG. 8 and FIG. 9 are spots of adhesive compound, such as spots of adhesive compound 181 and 182, which have been applied to the business forms by the tipping machine prior to attachment of the respective individual stencil assemblies thereto.

Figure 10:
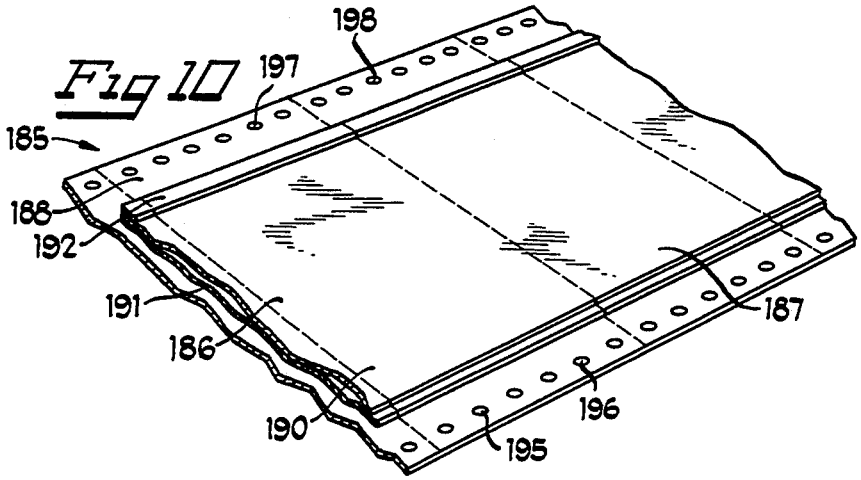
FIG. 10 of the drawings is a perspective partially cut-away view of a second embodiment combination stencil and label apparatus, showing in particular, the stencil material, label material, attachment material and the carrier medium associated therewith.

Combination stencil and label apparatus 185 is shown in FIG. 10 as comprising a plurality of individual stencil assemblies 186 and 187, releasably attached to carrier medium 188. Each of the individual assemblies comprise a sheet of stencil material 190, label means 191 and attachment means 192. Accordingly, no liner is contemplated in such an embodiment. Furthermore, each of the stencil assemblies, as well as the carrier medium, are perforated for easy removal. In addition, the carrier medium includes holes, such as holes 195 through 198, to facilitate use of the combination stencil and label apparatus with a computer printer and/or the like.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A combination stencil and label assembly for use in association with business forms, packaging and other surfaces, such as shipping containers, wherein the stencil of the assembly is capable of accepting the impressing of indicia which is simultaneously transferred to an underlying surface, and, wherein the stencil can be removed, in a facilitated manner, from the underlying surface, so as to enable reproduction of the impressed indicia on said other surfaces, such as shipping containers, in cooperation with a stencil applicator, said combination stencil and label assembly comprising:

label means for operable attachment to said business forms and other surfaces, as desired, said label means having a top surface, a bottom surface, and an outer periphery;

adhesive means covering substantially all of said bottom surface of said label means, a planar ply of stencil material having a first upper side, a second lower side, and an outer periphery, said second lower side being in juxtaposed alignment with said top surface of said label means, said stencil material having a substantially planar layer of carbon integrated into the second lower side of said stencil material to enable said simultaneous imprinting of said indicia to said top surface of said label means;

attachment means for releasably attaching at least a portion of said stencil material to at least a portion of said top surface of said label means, said stencil material being detachable from said label means through operable release of said attachment means so as to enable independent use of both said stencil material and said label means in cooperation with said packaging and said other surfaces;

liner means operably and releasably attached to said bottom surface of said label means by said adhesive means, said liner means providing a removable protective cover to said adhesive means on said bottom surface of said label means, said liner means having an upper surface, a lower surface, and a peripheral edge; and said adhesive means facilitating securement of said label means to at least a substantial portion of said upper surface of said liner means, while further facilitating independent securement of said label means to said other surfaces so that said simultaneous imprinting of said indicia to said top surface of said label means will be visually and operably observable upon said independent use of said label means with said packaging and said other surfaces.

2. The invention according to claim 1 in which said liner means further includes means for restrainably attaching said lower surface of said liner means to one of said business forms, packaging and other surfaces.

3. The invention according to claim 2 in which said liner means further includes image producing means integrated into said upper surface of said liner means for accepting and visually displaying said indicia impressed upon said stencil material and, in turn, said label means, upon simultaneous imprinting of said stencil material and said label means to impart to said liner means indicia identical to said indicia impressed on said stencil material and said label means thereby enabling use of said liner means as a label itself on said business forms, packaging and other surfaces.

4. The invention according to claim 2 in which the liner means comprises a single-ply image-producing liner.

5. The invention according to claim 2 in which the liner means comprises a piggy-back liner material having a carrier medium attached thereto.

6. The invention according to claim 2 in which said liner means has substantially the same configuration as said label means and said stencil material.

7. The invention according to claim 1 in which said combination stencil and label assembly is constructed to have a substantially rectangular configuration having four corners with a radius of curvature thereat.

8. The invention according to claim 7 in which said radius of curvature at each of said corners is approximately ¼ of an inch.

9. The invention according to claim 1 in which said combination stencil and label assembly includes preliminary imprinted indicia prior to said use in association with said business forms, packaging and other surfaces.

* * * * *

UNITED STATES PATENT AND TRADEMARK OFFICE

CERTIFICATE OF CORRECTION

PATENT NO. : 5,337,663

DATED : August 16, 1994

INVENTOR(S) : John J. McKillip

It is certified that error appears in the above-indentified patent and that said Letters Patent is hereby corrected as shown below:

| | |
|---|---|
| Col. 7 line 64 | Delete "impressing" and insert instead -- impression --. |

Signed and Sealed this

Tenth Day of January, 1995

*Attest:*

*Attesting Officer*

Bruce Lehman

BRUCE LEHMAN

*Commissioner of Patents and Trademarks*